US006126291A

United States Patent [19]

Chung-Kuang et al.

[11] Patent Number: 6,126,291

[45] Date of Patent: Oct. 3, 2000

[54] UMBRELLA HAVING DETACHABLE ILLUMINATIVE GRIP

[75] Inventors: Lin Chung-Kuang; Jung-Jen Chang, both of Taipei Hsien, Taiwan

[73] Assignee: Fu Tai Umbrella Works, Ltd., Taipei Hsien, Taiwan

[21] Appl. No.: 09/040,374

[22] Filed: Mar. 16, 1998

[51] Int. Cl.[7] ..... A45B 3/02

[52] U.S. Cl. ..... 362/102; 362/208; 135/910

[58] Field of Search ..... 362/102, 190, 362/191, 253, 208, 431, 158; 135/16, 910

[56] References Cited

U.S. PATENT DOCUMENTS

| | | | |
|---|---|---|---|
| 1,659,346 | 2/1928 | Beatty | 362/102 |
| 2,734,124 | 2/1956 | Funk | 362/102 |
| 4,872,468 | 10/1989 | Cole | 362/102 |
| 4,881,154 | 11/1989 | Tseng et al. | 362/102 |
| 5,493,480 | 2/1996 | Huang | 362/102 |
| 5,707,135 | 1/1998 | Miller, Jr. | 362/102 |

FOREIGN PATENT DOCUMENTS

| | | | |
|---|---|---|---|
| 128340 | 2/1929 | Germany | 362/102 |

*Primary Examiner*—Thomas M. Sember

[57] ABSTRACT

An umbrella includes: an illuminative grip detachably coupled to an inner grip portion formed on a bottom end of a central shaft of the umbrella. The illuminative grip has at least a battery detachably mounted in a cartridge of the grip, a lamp mounted in a cover detachably securable to the cartridge, and plural packing rings provided for sealing the connecting parts of the illuminative grip for water proof purpose. Upon detachment of the grip from the shaft of the umbrella, the grip having a lamp fixed thereon will serve as a portable independent flashlight for convenient illumination uses.

1 Claim, 5 Drawing Sheets

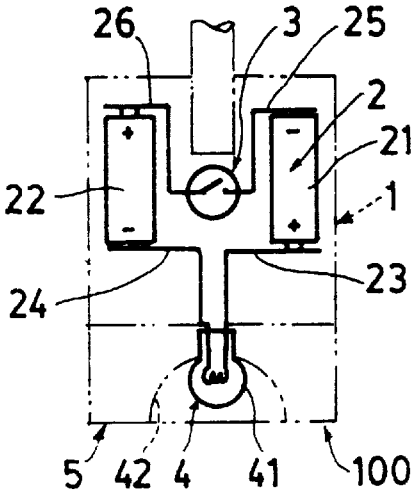
FIG. 3A
FIG. 3
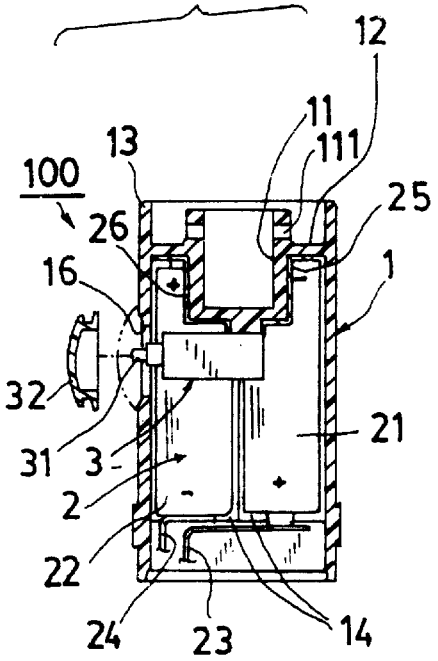
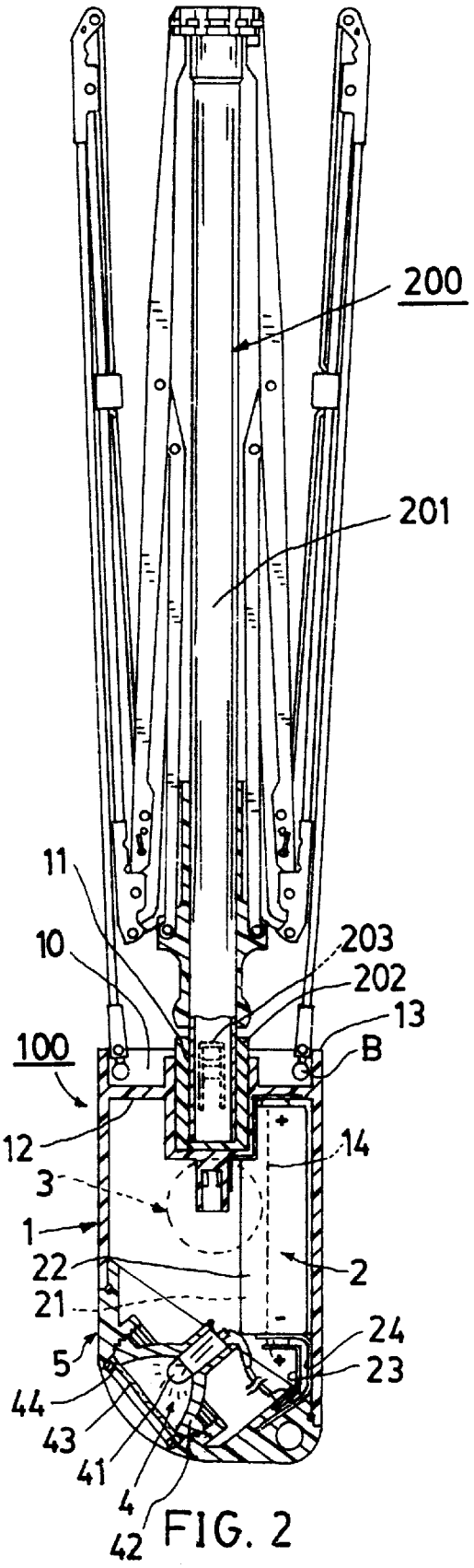
FIG. 2

UMBRELLA HAVING DETACHABLE ILLUMINATIVE GRIP

BACKGROUND OF THE INVENTION

U.S. Pat. No. 4,031,381 disclosed an illuminatable umbrella adapted to be illuminated selectively when in its open position. The bulb 26 is fixed on a top tip of the umbrella and is illuminated only when the umbrella is opened. So, it is inconvenient for illuminating purpose if the umbrella is unexpected to be opened or if the day is not rainy.

U.S. Pat. No. 3,275,815 disclosed an umbrella having a bulb fixed on the umbrella grip. Even it may be provided for illuminating use, the grip fixed with the bulb therein can not be detached from the umbrella shaft for serving as a separable flashlight for dynamic convenient illumination purposes.

The present inventor has found the drawbacks of the prior arts and invented the present umbrella having detachable illuminative grip.

SUMMARY OF THE INVENTION

The object of the present invention is to provide an umbrella including: an illuminative grip detachably coupled to an inner grip portion formed on a bottom end of a central shaft of the umbrella, with the illuminative grip having at least a battery detachably mounted in a cartridge of the grip, a lamp mounted in a cover detachably securable to the cartridge, and plural packing rings provided for sealing the connecting parts of the illuminative grip for water proof purpose, whereby upon detachment of the grip from the shaft of the umbrella, the grip having a lamp fixed thereon will serve as a portable independent flashlight for convenient illumination uses.

BRIEF DESCRIPTION OF THE DRAWINGS

FIG. 2 is a partial sectional drawing of an umbrella of the present invention.

FIG. 3 is a sectional drawing of the partial illuminative grip of the present invention.

FIG. 3A is a circuit diagram of the illuminative grip of the present invention.

DETAILED DESCRIPTION

Figure 8:
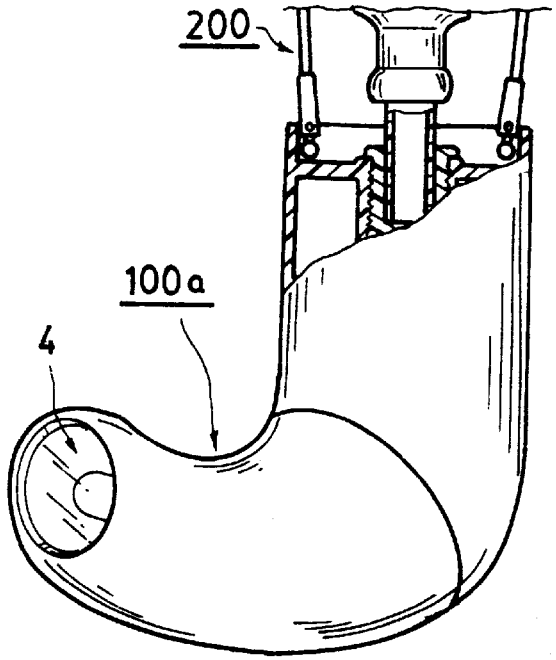
FIG. 8 shows still another preferred embodiment of the present invention.

As shown in FIGS. 1–5, the present invention comprises: an illuminative grip 100 detachably coupled to a central shaft 201 of an umbrella 200. The illuminative grip 100 may be varied for its shapes, designs or structures as shown in FIG. 8 and may be detachably coupled to the shaft 201 of the umbrella. Namely, an unique umbrella shaft may be optionally connected with variable grips 100.

The central shaft 201 of the umbrella 200 includes an inner grip portion 202 formed at a bottom end of the shaft

201 having a fastener 203 formed on the inner grip portion 202 to be engageable with a fastener hole formed in the grip 100 for coupling the grip 100 with the shaft 201. The fastener 203 may be a buckle, a screw (with threads), or any other fastening or coupling devices, not limited in the present invention. The cartridge 1 is formed with a hanging hole 101 for passing a rope therethrough for hanging purpose.

The illuminative grip 100 includes: a cartridge 1 having a sleeve portion 11 formed in a central portion of an upper end plate 12 closing an upper portion of the cartridge 1 for detachably coupling the inner grip portion 202 of the central shaft 201 of the umbrella 200, a battery chamber 14 formed in an interior of the cartridge 1 for storing the power source 2 including at least a battery in the battery chamber 14, a lamp means 4 secured in a cover 5 which is detachably connected to a lower portion of the cartridge 1 opposite to the upper end plate 12, and electrically connected to the power source 2 through a switch means 3 mounted on the cartridge 1 to be powered by the power source 2 for illuminating the lamp means 4 which is switched on or off by the switch means 3.

The number, shapes and power (watts) of the battery (batteries) of the power source 2 are not limited in the present invention. There are two batteries 21, 22 shown in the drawings of this application. The electric circuit and switch means for connecting the lamp means 4 with the power source 2 are also not limited in the present invention.

The switch means 3 includes a push button 31 for switching on or off the lamp means 4 secured in the cover 5, and a cap member 32 made of elestomers (such as rubber) for encasing the push button 31 and sealably secured on the button hole 16 formed in the cartridge 1 for water-proof purpose.

The lamp means 4 includes a bulb 41 electrically connected to the power source 2 through the switch means 3, and a shade 42 having the bulb 41 fixed therein and secured in a lamp socket 52 formed in the cover 5 which is secured to a lower portion of the cartridge 1 by a packing member 51 for water proof purpose.

A lens or transparent front cover 43 is embedded in a front portion of the shade 42 beyond the bulb 41 by means of a packing ring 44. The shade 42 is formed with male threads 421 to be engaged with the female-threaded hole formed in the lamp socket 52 of the cover for firmly fixing the shade 42 in the cover 5.

The cartridge 1 further includes: an annular groove 10 annularly defined between the sleeve portion 11 and an outer periphery 13 disposed about an upper edge portion of the cartridge 1 for receiving a plurality of tips B each formed on an end portion of each rib of the umbrella when folding and closing the umberlla as shown in FIG. 2.

The cartridge 1 includes a pair of lugs 15 disposed on opposite sides of the cartridge 1 for fixing the cover 5 by a pair of screws 151, whereby upon detachment of the cover 5 from the cartridge 1, the battery of the power source 2 in the battery chamber 14 in the cartridge 1 may be replaceable.

The sleeve portion 11 may be formed with a fastener hole or buckle hole 111 therein for engaging the fastener or buckle 203 formed on the inner grip portion 202 of the central shaft 201 for coupling the grip 100 to the umbrella 200.

Figure 6:
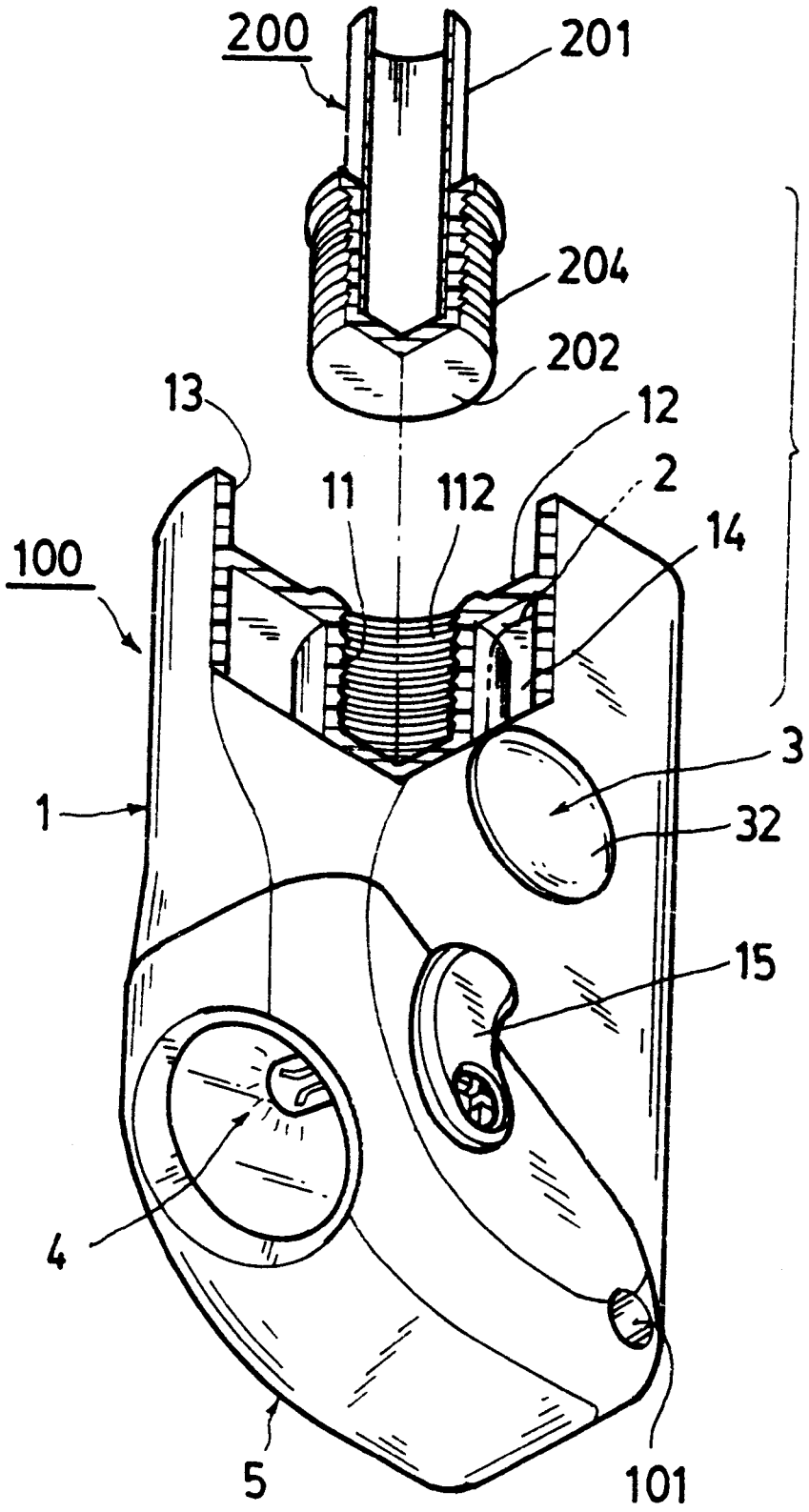
FIG. 6 is a perspective view of another preferred embodiment of the present invention.
Figure 7:
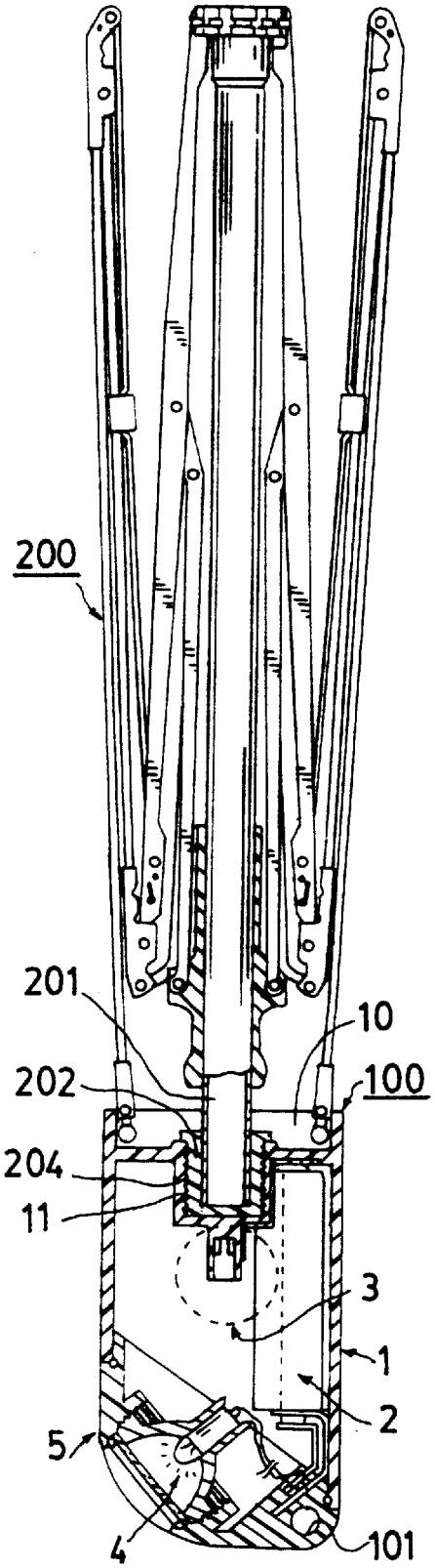
FIG. 7 is a partial sectional drawing of the embodiment of FIG. 6.

The sleeve portion 11 may also be formed with a female-threaded hole 112 therein for engaging a male-threaded portion 204 formed on the inner grip portion 202 of the shaft 201 for coupling the grip 100 to the umbrella 200 as shown in FIGS. 6, 7.

An electric circuit for connecting the lamp means 4 with the power source 2 through the switch means 3 is shown in FIGS. 2, 3, 3A, 4; in which the power source 2 includes: a first battery 21 connected in series with a second battery 22, a first connecting wire (or strip) 23 electrically connected between) a first lead of a bulb 41 of the lamp means 4 and a positive pole of the first battery 21, a second connecting wire (or strip) 24 electrically connected between a second lead of the bulb 41 and a negative pole of the second battery 22; and two connectors 25, 26 electrically connected in series between a negative pole of the first battery 21 and a positive pole of the second battery 22 through the switch means 3 intermediate the two connectors 25, 26 especially as shown in FIG. 3A. Upon switching on of the switch means 3, the bulb 41 will be turned on for illumination.

Figure 1:
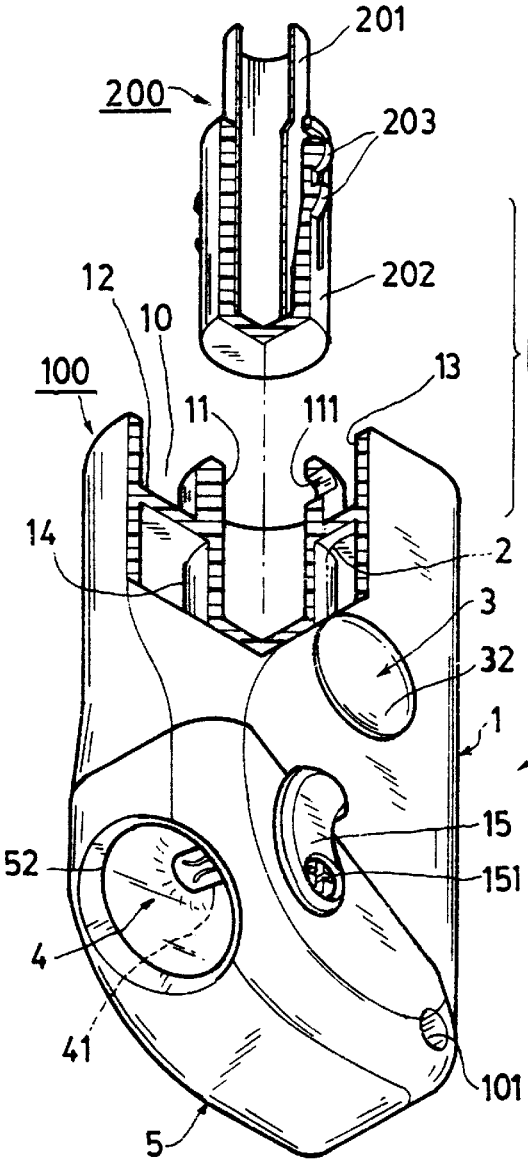
FIG. 1 is a partial cut-away illustration of the present invention.
Figure 5:
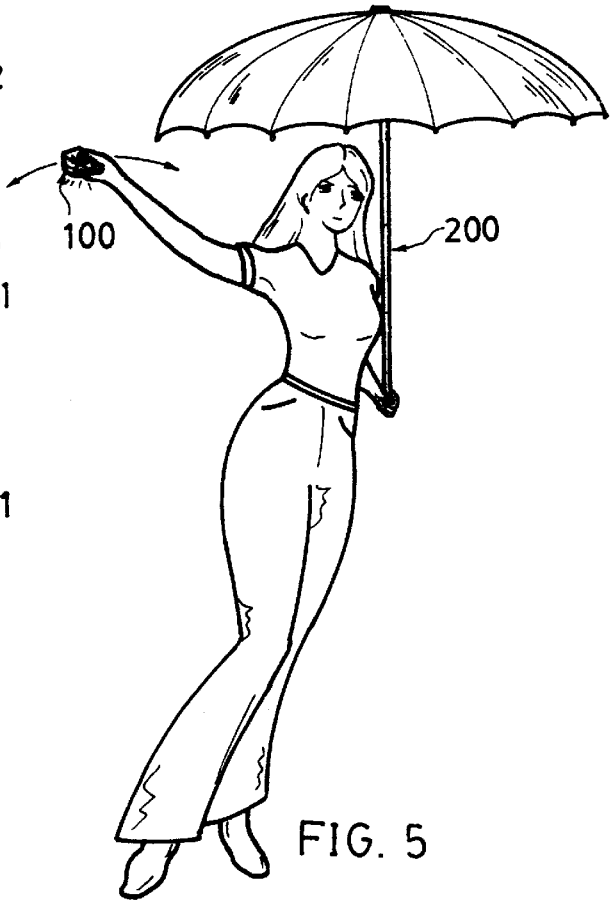
FIG. 5 is an illustration showing an illumination use as effected by the present invention.
Figure 4:
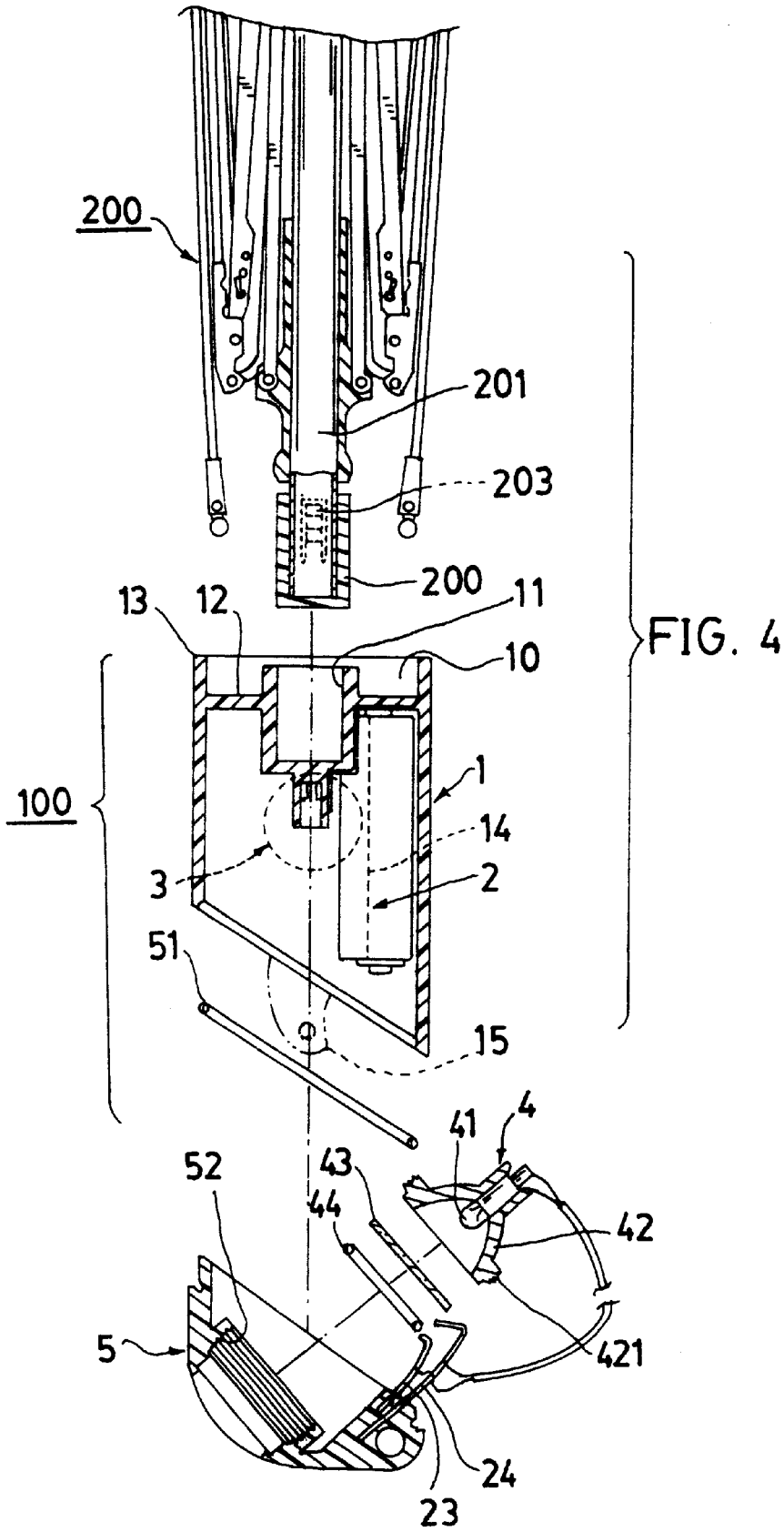
FIG. 4 is an exploded view of the present invention.

The present invention has the following advantages superior to the prior arts:

1. The illuminative grip 100 may be easily, quickly detached from the umbrella shaft 201 for signalling or warning use as shown in FIG. 5 such as for emergency call for help.

2. The electric circuit including the push button, the battery, the bulb and the wires is well sealed in the cartridge 1 and the cover 5 for water-proof purpose.

3. The grips 100 may be made by mass production in a factory, each grip 100 easily coupled to the umbrella 200 for facilitating the assembly of the umbrella, simplifying the production, and decreasing the production cost. For repairing or maintenance, each grip 100 may be instantly removed from the umbrella shaft for a quick and well maintenance of the umbrella. So, the grips are each like a "cassette" or a "module" as satisfactorily beneficial for a factory assembly, an inventory control and a repair service.

4. Variable grips 100 may be optionally, selectively or interestingly coupled to an unique umbrella shaft 201 with convenience, thereby increasing the selectivity beneficial for the umbrella users and the makers.

The present invention may be modified without departing from the spirit and scope of this invention. The electric circuit of the power source, the lamp means and the switch means may be further modified without being limited to that as shown in FIG. 3A.

What is claimed is:

1. An umbrella comprising:

a central shaft having an inner grip portion formed on a bottom end portion of the central shaft and having a fastener formed on said inner grip portion adapted for fastening and coupling an illuminative grip with said inner grip portion on said central shaft; said illuminative grip detachably coupled to said central shaft of said umbrella and including:

a cartridge having a sleeve portion formed in a central portion of an upper end plate closing an upper portion of the cartridge for detachably coupling the inner grip portion of the central shaft of the umbrella and having an annular groove annularly defined between the sleeve portion and an outer periphery disposed about an upper edge portion of the cartridge for receiving a plurality of tips each formed on an end portion of each rib of the umbrella when folding and closing the umbrella, a battery chamber formed in an interior of the cartridge for storing a power source including at least a battery in the battery chamber, a lamp means secured in a cover which is detachably connected to a lower portion of the cartridge opposite to the upper end plate, and electrically connected to the power source through a switch means mounted on the cartridge to be powered by the power source for illuminating the lamp means which is switched on or off by the switch means;

whereby upon detachment of said illuminative grip from said umbrella, said grip is separable from said umbrella for a convenient illumination by switching on said lamp means on said grip.

* * * * *